US005555601A

United States Patent [19]

Schultz

[11] Patent Number: 5,555,601

[45] Date of Patent: Sep. 17, 1996

[54] ERGONOMIC AND EASILY SERVICEABLE VACUUM PROBE

[75] Inventor: Perry D. Schultz, North Tonawanda, N.Y.

[73] Assignee: Wilson Greatbatch Ltd., Clarence, N.Y.

[21] Appl. No.: 216,491

[22] Filed: Mar. 22, 1994

[51] Int. Cl.[6] ..... A47L 5/24

[52] U.S. Cl. ..... 15/339; 15/344; 15/419

[58] Field of Search ..... 15/314, 339, 344, 15/415.1, 419; 239/530, 586, DIG. 21

[56] References Cited

U.S. PATENT DOCUMENTS

| | | | |
|---|---|---|---|
| 1,644,226 | 10/1927 | Bedard | 239/586 |
| 2,128,200 | 8/1938 | Allen | 15/415.1 |
| 2,910,717 | 11/1959 | Raymond | 15/339 |
| 3,071,402 | 1/1963 | Lasto | 15/419 |
| 3,129,892 | 4/1964 | Tillman | 239/586 |
| 3,774,847 | 11/1973 | Malec | 239/586 |
| 3,818,539 | 6/1974 | Fortune | 15/344 |
| 3,842,240 | 10/1974 | Wakita | 15/344 |
| 4,532,670 | 8/1985 | Fortune | 15/314 |
| 5,020,726 | 6/1991 | Myres | 239/DIG. 21 |
| 5,211,131 | 5/1993 | Plyler | 15/344 |

*Primary Examiner*—David Scherbel
*Assistant Examiner*—Terrence R. Till
*Attorney, Agent, or Firm*—Hodgson, Russ, Andrews, Woods & Goodyear LLP

[57] ABSTRACT

Ergonomic and easily serviceable vacuum probe. The probe for applying a vacuum has a see-through chamber in which a particulate filter is disposed so that the contamination level in the chamber is monitorable for servicing the filter. The probe is vacuum-dependent and sized to be gripped by a person's hand making a fist therearound including around the handle which extends longitudinally of the body. By squeezing the handle toward the body, a valve plunger is pushed radially inwardly to open the valve to apply vacuum. The valve is spring-biased to return to the closed position upon release of the handle.

12 Claims, 2 Drawing Sheets

ERGONOMIC AND EASILY SERVICEABLE VACUUM PROBE

The present invention relates to devices for applying a vacuum such as for micro-vacuum cleaning and small part pickup and handling applications.

During the manufacture of small electronic components and the like, it is often necessary to insure that dust and the like is removed therefrom. In the medical industry, there are also applications for such micro-vacuuming.

Various vacuuming devices have been proposed examples of which are found in U.S. Pat. Nos. 3,444,584; 3,897,604; 4,221,017; 4,302,225; 4,488,331; 4,918,857; and 4,989,292. These devices have various drawbacks. Thus, they may not be easily operable. For example, the button for operating the vacuum desoldering tool of U.S. Pat. No. 4,221,017 to Fortune requires finger operation, must be located for manipulation by the finger, and does not offer a mechanical advantage. Neither does the handle of the apparatus of U.S. Pat. No. 3,897,604 to Weimer allow good operation ergonomically. Neither may such vacuuming devices allow easy or user friendly serviceability. For example, it may be difficult to detect when particulate filters in such devices need cleaning or replacement.

It is accordingly an object of the present invention to provide a vacuum probe which allows easy detection of the need for cleaning or replacement of a particulate filter.

It is a further object of the present invention to provide a hand-held vacuum probe having an ergonomically-suitable handle for operating to provide vacuum on-demand.

It is another object of the present invention to provide such a vacuum probe which is of light weight, easy to service, rugged, effective, and inexpensive.

In order to allow easy detection of the need for cleaning or replacement of a particulate filter, in accordance with the present invention a chamber in which the filter is disposed is composed of see-through material.

Also in accordance with the present invention the device has an elongate generally cylindrical body and a handle pivotally connected thereto for operating a valve and extending generally longitudinally of the body so that the body and handle can together be gripped by a person's hand making a fist therearound, and an intermediate portion of the handle depresses a valve plunger for opening the valve passage, the plunger being biased to close the passage whereby, upon release of the handle, the plunger returns to a position closing the passage, and the device being vacuum dependent.

The above and other objects, features, and advantages will be apparent in the following detailed description of the preferred embodiment of the present invention when read in conjunction with the accompanying drawings wherein the same reference numerals denote the same or similar parts throughout the several views.

DETAILED DESCRIPTION OF THE PREFERRED EMBODIMENT

Figure 1:
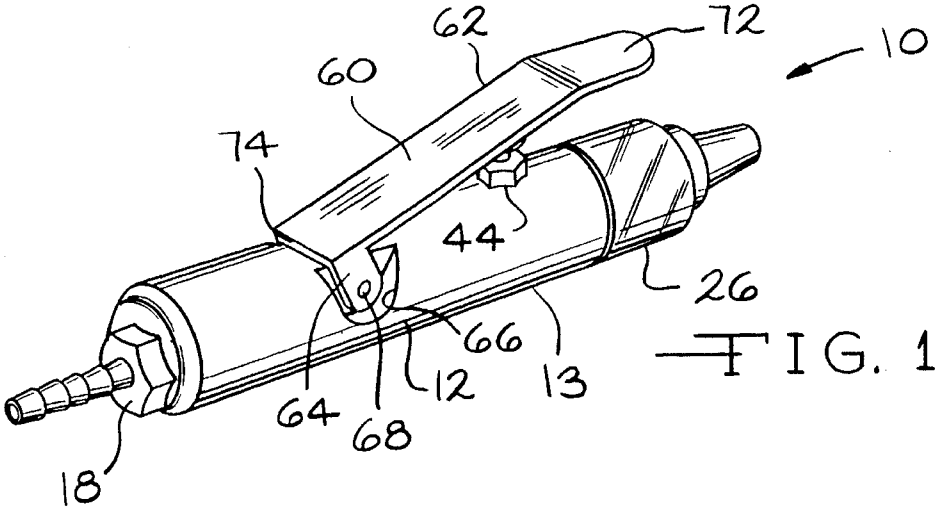
FIG. 1 is a perspective view of a device which embodies the present invention.

Referring to the drawings, there is shown generally at 10 a hand-held vacuum probe for micro-vacuum cleaning and small part pickup and handling applications. For example, the probe 10 may be used surgically as a vacuum extraction device with containment. The device 10 includes an elongate generally cylindrical body 12 having a vacuum passage 14 extending generally longitudinally therethrough. A longitudinally extending threaded aperture 16 is provided in the rearward end of the body portion 13 in flow communication with the passage 14. Body portion 13 may be composed of aluminum or other suitable material. A suitable fitting 18 such as, for example, a ⅛ inch clippard fitting is threadedly received in threaded aperture 16 and includes a passage 22 which extends longitudinally therethrough in flow communication with passage 14 for connection to a vacuum source (not shown) so that the device 10 may be vacuum-dependent and thus not contain a venturi with the result that the device 10 may be of lighter weight and smaller size for easier handling, less expensive operation, and not subject to clogging of the venturi. Aperture 16 may, for example, be provided to accept any fitting having a 1/16 NPT.

Figure 3:
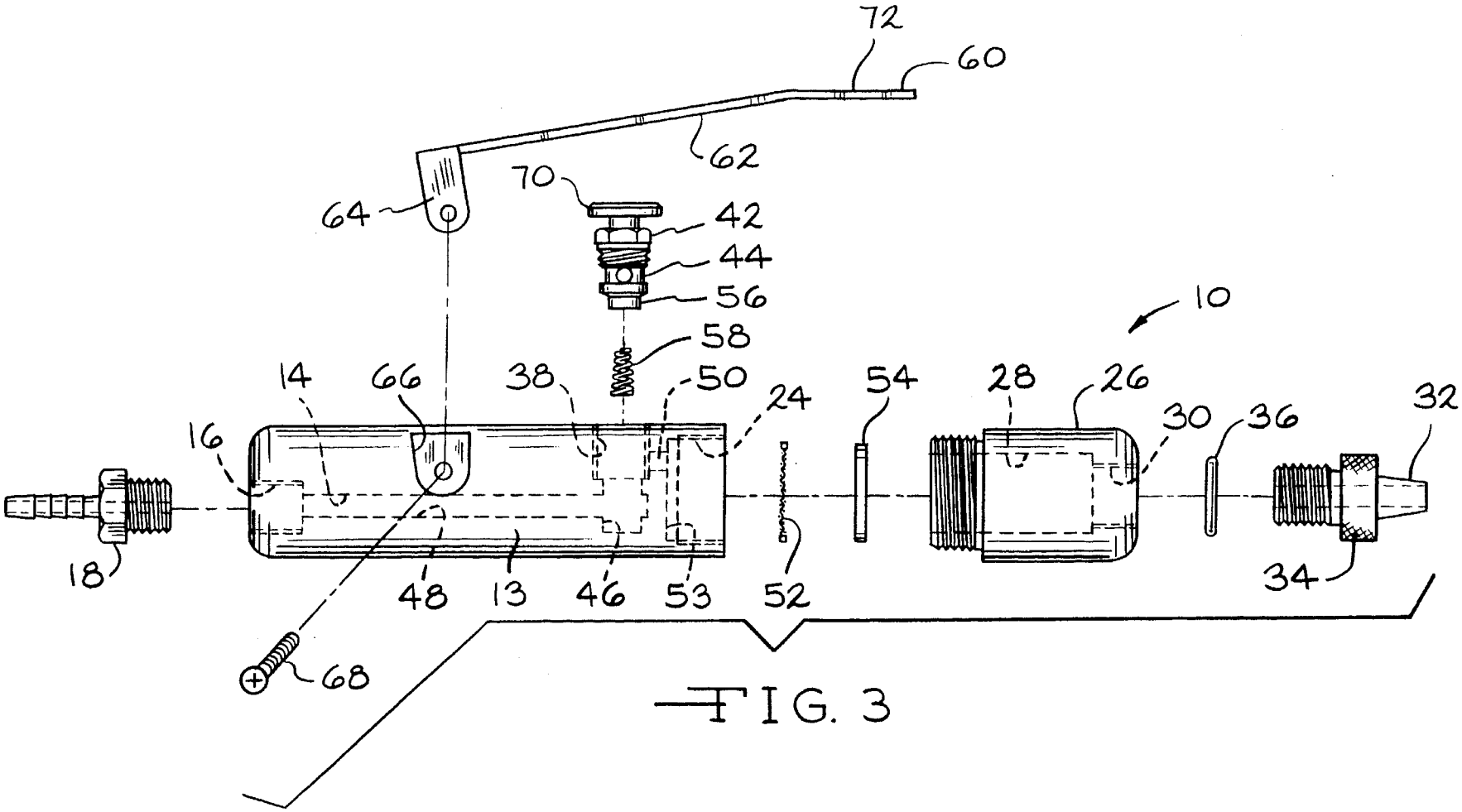
FIG. 3 is an exploded view thereof.

A longitudinally extending threaded aperture 24 is provided in the forward end of the body portion 13 in communication with body passage 14 for threadedly receiving a generally cylindrical elongate member 26 shaped to define a chamber 28 co-axially with body portion 13. A threaded aperture 30 is provided in the forward end of chamber member 26 for threadedly receiving a replaceable nozzle or tip 32 co-axially with the member 26 and body portion 13. Nozzle 32 may be composed of aluminum or other suitable material. Aperture 30 opens into chamber 28, and nozzle 32 includes a vacuum passage 20 extending longitudinally therethrough and in flow communication with chamber 28. The nozzle 32 includes a radially enlarged portion 34 intermediate the ends thereof, and a suitable O-ring 36 is disposed between the enlarged portion 34 and the forward end wall of chamber member 26 for sealing. The nozzle 32 may be hand-tightened, and the portion 34 may, if desired, be knurled, as illustrated in FIG. 3, for this purpose. Alternatively, the portion 34 may, if needed, be hex-shaped or the like for receiving a wrench.

The forward end portion of the body portion 13 has a radially extending opening 38 which is in flow communication with passage 14, and the radially outer portion 40 of opening 38 is threaded for receiving the body 42 of a suitable valve 44 such as, for example, an Air-Vac spool valve. Extending rearwardly from a radially inner portion 46 of opening 38 is a portion 48 of the passage 14, and extending forwardly from the radially outer portion 40 of the opening 38 is another portion 50 of passage 14. Passage portion 50 opens into aperture 24 and is thus in flow communication with chamber 28.

When connected to a vacuum source at the rearward end by fitting 18, the probe 10 provides a vacuum suction at the forward end via the removable tip 32, the vacuum route being nozzle passage 20, chamber 28, body passage 14 including passage portions 50 and 48, and fitting passage 22. Demand is controlled by operation of valve 44, as hereinafter discussed.

A suitable replaceable particulate filter 52 such as, for example, a Tetco wire filter screen is disposed at the axially inner surface 53 defining aperture 24, i.e., the bottom of the aperture 24. Filter 52 is secured in position by the rearward end of chamber member 26 with a Delrin or other suitable washer 54 therebetween.

Vacuum flow or suction initiates when the vacuum passage through the device 10 is opened by operating valve 44. All vacuum is drawn through the removable chamber 28. Particulate is filtered from the vacuum stream upon exiting the chamber 28 through the replaceable filtering screen 52. The replaceable tip 32 and filtering chamber 28 are threadedly-attached for user serviceability, i.e., cleaning and replacement of the filter 52.

In order to allow users to monitor the contamination level in the chamber 28 so as to clean or replace the screen 52 as needed, in accordance with the present invention the dust chamber member 26 is composed of a suitable see-through material such as, for example, a clear acrylic material.

Figure 2:
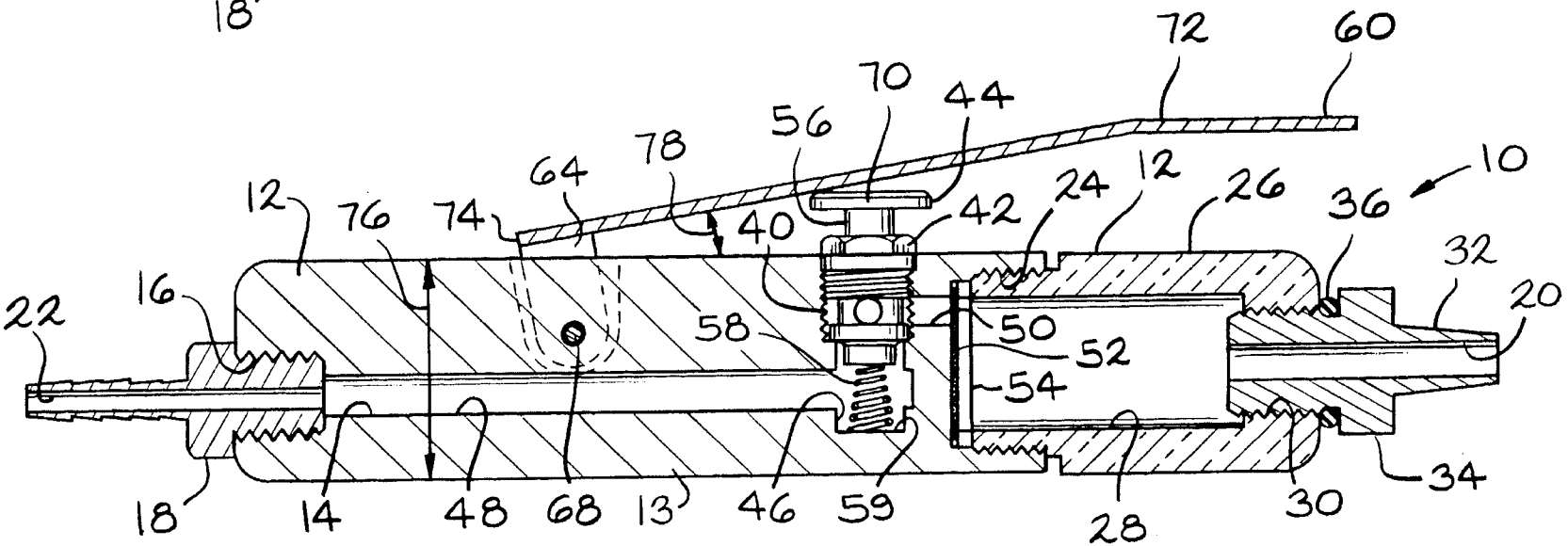
FIG. 2 is a longitudinal cross-sectional view thereof.

The passage 14 is closed when the valve plunger 56 extends radially outwardly to seat the valve, as shown in FIG. 2. The plunger 56 is biased to return to this closed position by spring 58, which is disposed between the bottom of the plunger 56 and the radially inner surface 59 defining opening 38, i.e., the bottom of opening 38. Movement of the plunger 56 radially inwardly by means of handle 60 forces the plunger 56 from the seat to open the passage 14 to vacuum flow. Release of the handle 60 allows the spring 58 to return the plunger 56 to the closed position to close the passage 14 to vacuum flow. Thus, the operation of the vacuum probe 10 is on-demand.

The handle 60, which may be composed of 16 gage stainless sheet steel or other suitable material, comprises a thin elongate member 62 which is pivotally attached at one end to the body portion 13. The pivotally-attached or fulcrum end of handle 60 has a pair of ears 64 normal to member 62 on opposite sides thereof. These ears 64 are received in cut-outs or notches 66 in the body portion 13 on opposite sides thereof and spaced rearwardly of valve 44. These cut-outs 66 have inner surfaces to which the ears 64 are pivotally attached such as by respective pan head machine screws 68 (only one shown), which are assembled loosely with Loctite adhesive so that the handle 60 may be pivotally manipulated but so that the screws 68 do not work loose.

The handle member 62 extends forwardly from ears 64 generally longitudinally of the body at a small angle, illustrated at 78, of less than perhaps about 10 degrees relative to the axis of body 12 so that an intermediate portion of the handle member 62 overlies the enlarged head 70 of the valve plunger 56. The handle member 62 is formed so that the forward terminal end portion 72 (forward of valve 44) is substantially parallel to the axis of body 12 so that the radial extent to which the handle extends is limited for easier holding and manipulation by a user's hand. The length of the handle member 62 is preferably greater than about half of the length of the body 12. By squeezing the handle 60 toward the body 12, the valve plunger 56 is pushed radially inwardly by an intermediate portion of the handle member 62 to open the valve 44 for application of vacuum at the nozzle 32. When the handle 60 is released, spring 58 exerts a force to close the valve 44. The contact of the rearward edge 74 of the handle 60 with the body portion 13 (with the corresponding point of tangency thereof) acts as a "stop" to limit pivotal movement of the handle 60 so that it remains positioned to extend within the small angle 78 relative to the axis of body 12 so as to lie closely to the body 12 to allow easier grasping and manipulation of the vacuum probe. Alternatively, if desired, the rearward edges of the cut-outs 66 may be provided to act as such a stop.

Connected to a vacuum source by means of fitting 18 so as to be vacuum-dependent whereby the vacuum probe may be smaller in size for easier manipulation and easier to maintain, the probe 10 provides a vacuum force at the removable tip 32 on the opposite end. Demand is controlled by depressing the ergonomically-constructed lever or handle 60, which is sized to accommodate single finger, thumb, or multiple finger-grasping actuation. Vacuum flow initiates when the mechanical advantage lever 60 forces the spring-loaded spool valve from its seat, and all vacuum is drawn into the removable see-through chamber 28. Particulate is filtered from the vacuum stream upon exiting the chamber 28 through the replaceable filtering screen 52. It should be understood that the probe 10 may, if desired, be connected to an air pressure source to be used for blowing a stream of air onto an object.

The vacuum supply line is connected to the fitting 18 which extends axially from the rear end of the body 12 so as to avoid interference by the supply line with a full hand grip on the device 10. The handle 60 is positioned and sized to allow a variety of choices for manipulation of the probe 10. For example, it may be held and used like a pencil or like a die-grinder, i.e., by making a fist around the device 10 and depressing the handle 60 with the palm of the hand. The device 10 may be held at various orientations to the work depending on the nature of the grip. In order to allow suitable gripping of the probe ergonomically, the body is sized to have a diameter, illustrated at 76, which is less than about 1 inch.

By way of example and not for purposes of limitation, the following are exemplary dimensions for the probe 10 so that it may be easily held in one's hand and operated. The overall length of the probe 10 may be perhaps between about 4 and 5 inches. Its overall diameter (diameter of body portion 13 and dust chamber 26) may perhaps be about 0.8 inch. The handle length is preferably proportioned to a person's hand, and the handle is sized to fit comfortably in the hand. Thus, the handle member 62 may have a width of perhaps about ½ inch and an overall length of perhaps about 2.89 inches. The handle end portion 72 may have a length of perhaps about 0.76 inch and may form an included angle with the rest of the handle member of perhaps about 170 degrees. The distance between the cut-outs 66 and valve 44 may perhaps be about 2-¾ inches. The valve plunger 56 may, when the value is closed, extend radially outwardly of the body 12 a distance of perhaps about 3/16 inch. Such a device is provided to be easily gripped by a person's hand making a fist therearound whereby the handle may be merely squeezed to apply vacuum and released to stop applying vacuum.

It should be understood that, while the present invention has been described in detail herein, the invention can be embodied otherwise without departing from the principles thereof, and such other embodiments are meant to come within the scope of the present invention as defined by the appended claims.

What is claimed is:

1. An elongate generally cylindrical vacuum-dependent device sized to be gripped by a person's hand making a fist therearound for applying a vacuum on demand comprising an elongate generally cylindrical body having a longitudinal axis and a length, means for connecting said body to a vacuum source, tip means defining an elongate passage having an axially outer opening to said body, said tip means adapted for applying of a vacuum from the vacuum source to the axially outer opening, passage means including means defining a chamber and extending in said body between said vacuum source connecting means and said tip means for directing a vacuum from the vacuum source to said tip means, valve means including a plunger extending radially outwardly of said body and moveable radially outwardly to a first position and radially inwardly to a second position for closing and opening respectively said passage means, means for biasing said valve means to close said passage means, an elongate handle having a length and extending generally longitudinally of said body so that said body and said handle can together be gripped by a person's hand making a fist therearound and having an end portion pivotally connected to said body and spaced from said plunger so that an intermediate portion of said handle overlies said plunger, and said handle being pivotal between a position wherein said plunger is in said first position and a position wherein said handle is depressed toward said body to depress said plunger radially inwardly to said second position whereby, upon release of said handle, said plunger returns to said first position to close said passage means, a particulate filter disposed in said chamber, and means including a portion of said body which is composed of see-through material for allowing viewing into said chamber while a vacuum is being applied whereby a contamination level in the chamber is monitorable, by looking through said see-through material into the chamber, for servicing the filter.

2. A device according to claim 1 wherein said chamber is threadedly connected to said body to be removable for servicing the filter and said filter is removable.

3. A device according to claim 1 wherein said tip means is removable.

4. A device according to claim 1 wherein said see-through material defines and extends around said chamber for allowing viewing into said chamber from around said chamber while a vacuum is being applied.

5. An elongate generally cylindrical vacuum-dependent device sized to be gripped by a person's hand making a fist therearound for applying a vacuum on demand comprising an elongate generally cylindrical body having a longitudinal axis and a length, means for connecting said body to a vacuum source, tip means defining an elongate passage having an axially outer opening to said body, said tip means adapted for applying of a vacuum from the vacuum source to the axially outer opening, passage means extending in said body between said vacuum source connecting means and said tip means, valve means including a plunger extending radially outwardly of said body and movable radially outwardly to a first position and radially inwardly to a second position for closing and opening respectively said passage means, means for biasing said valve means to close said passage, means, an elongate handle having a length and extending generally longitudinally of said body so that said body and said handle can together be gripped by a person's hand making a fist therearound and having an end portion pivotally connected to said body and spaced from said plunger so that an intermediate portion of said handle overlies said plunger, and said handle being pivotal between a position wherein said plunger is in said first position and a position wherein said handle is depressed toward said body to depress said plunger radially inwardly to said second position whereby, upon release of said handle, said plunger returns to said first position to close said passage means, and body having a diameter generally throughout the length thereof which is less than about 1 inch, and said handle is disposed to extend over the length thereof at an angle which is less than about 10 degrees relative to the longitudinal axis of said body, wherein said body includes a portion composed of see-through material defining a chamber, said passage means including said chamber, and a particulate filter disposed in said chamber whereby a contamination level in the chamber is monitorable for servicing the filter.

6. A device according to claim 5 wherein said body includes means defining a pair of notches and said handle end portion includes a pair of ears extending into said pair of notches respectively and pivotally connected to said body, said notch means including means for limiting movement of said handle pivotally away from said body.

7. A device according to claim 6 wherein said handle has a terminal end portion oriented to be substantially parallel to the longitudinal axis of said body.

8. A device according to claim 5 wherein the device has a length and wherein said handle has a length which is greater than about half of the length of the device and a width which is equal to about ½ inch.

9. A device according to claim 5 wherein said valve means comprises a spring-loaded spool valve.

10. A device according to claim 5 wherein said chamber is threadedly connected to said body to be removable for servicing the filter, and said filter is removable.

11. A device according to claim 5 wherein said tip means is removable.

12. A device according to claim 5 wherein said see-through material defines and extends around said chamber for allowing viewing into said chamber from around said chamber while a vacuum is being applied.

* * * * *